US009862468B2

(12) United States Patent
O'Sullivan et al.

(10) Patent No.: US 9,862,468 B2
(45) Date of Patent: Jan. 9, 2018

(54) FLOATING PLATFORM WITH AN ARTICULATING KEEL SKIRT

(71) Applicant: TECHNIP FRANCE, Courbevoie (FR)

(72) Inventors: James Francis O'Sullivan, Houston, TX (US); Johyun Kyoung, Katy, TX (US)

(73) Assignee: TECHNIP FRANCE, Coubevoie (FR)

( * ) Notice: Subject to any disclaimer, the term of this patent is extended or adjusted under 35 U.S.C. 154(b) by 5 days.

(21) Appl. No.: 14/511,717

(22) Filed: Oct. 10, 2014

(65) Prior Publication Data

US 2016/0101836 A1 Apr. 14, 2016

(51) Int. Cl.
*B65D 88/78* (2006.01)
*B63B 41/00* (2006.01)
(Continued)

(52) U.S. Cl.
CPC ..... *B63B 41/00* (2013.01); *B63B 35/44* (2013.01); *B63B 35/4413* (2013.01); *B63B 39/00* (2013.01); *B63B 2035/448* (2013.01)

(58) Field of Classification Search
CPC ..... B63B 35/00; B63B 35/34; B63B 35/44; B63B 38/00; B63B 39/00; B63B 41/00; B63B 2035/00; B63B 2035/44; B63B 2035/442; B63B 2035/4426; B63B 2035/448; B63B 2035/4486; B63B 2039/00; B63B 2039/06; B63B 2039/067; B63B 2041/00; B63B 2041/003;
(Continued)

(56) References Cited

U.S. PATENT DOCUMENTS 2,699,321 A * 1/1955 Nelson ..... E02B 17/021 114/260
3,165,898 A * 1/1965 Elliott ..... E21B 7/12 114/261
(Continued)

FOREIGN PATENT DOCUMENTS

CA 2897223 A1 7/2014
GB 2253813 9/1992

OTHER PUBLICATIONS

International Search Report, International Application No. PCT/US2015/054999, dated Jan. 28, 2016, 3 pages.
(Continued)

*Primary Examiner* — Daniel V Venne
(74) *Attorney, Agent, or Firm* — Jackson Walker, LLP

(57) ABSTRACT

The present disclosure provides in at least one embodiment a rotatable keel skirt assembly on a rectangular-shaped keel pontoon. The rectangular-shaped keel pontoon reduces the maximum hull width by a significant percentage compared to a circular-shaped keel pontoon while maintaining the same hull motion performance. The rotatable keel skirt assembly allows the size of the pontoon to define the width of the hull during some fabrication phases of the platform, rather than the additional width of the keel skirt assembly. Thus, the outreach of the crane and other equipment can be effectively used as if the keel skirt assembly was not present. After fabrication, the hull can be moved away from the quayside and the keel skirt assembly can be rotated into position for service. Various systems and methods are disclosed for articulating the keel skirt assembly about the hull.

18 Claims, 12 Drawing Sheets

(51) Int. Cl.
*B63B 35/44* (2006.01)
*B63B 39/00* (2006.01)

(58) Field of Classification Search
CPC ..... E02B 17/02; E02B 17/06; E02B 17/025; E02B 2017/29
USPC ..... 114/256–267; 405/204
See application file for complete search history.

(56) References Cited

U.S. PATENT DOCUMENTS 3,571,831 A * 3/1971 Conklin ..... B29C 35/06 114/263
4,295,758 A 10/1981 Yashima
4,738,566 A 4/1988 Marthinsen
5,125,769 A * 6/1992 Lee ..... E02B 17/00 114/264
5,609,442 A * 3/1997 Horton ..... B63B 9/065 405/196
D476,998 S 7/2003 Olsen et al.
6,761,508 B1 * 7/2004 Haun ..... B63B 35/4413 114/264
6,945,736 B2 9/2005 Smedal et al.
7,086,810 B2 8/2006 Masetti et al.
8,511,246 B2 8/2013 Srinivasan
8,544,402 B2 10/2013 Vandenworm
2010/0288178 A1 * 11/2010 Mansour ..... B63B 39/00 114/265
2015/0322640 A1 * 11/2015 Wu ..... E02B 17/02 405/204

OTHER PUBLICATIONS

Written Opinion of the International Searching Authority, International Application No. PCT/US2015/054999, dated Jan. 28, 2016, 5 pages.

* cited by examiner

FLOATING PLATFORM WITH AN ARTICULATING KEEL SKIRT

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to hydrocarbon floating, production, storage, and/or offloading platforms. Specifically, the disclosure relates to such floating platforms having keel skirts to change a heave response of such platform while floating in water.

Description of the Related Art

A typical line up of offshore platforms for hydrocarbon production, storage, and/or offloading includes a deep draft spar suitable for heave control in deep waters, a semi-submersible platform, a tension leg platform, and specialized ship-shaped floating structures for production, storage, and offloading known as FPSOs. Each type has advantages that have been used in different parts of the world depending on types of weather and environment, depth of the water, and other factors.

Specifically, ship-shaped FPSOs have been used throughout the oil and gas industry for decades. But their transverse motion (roll motion) is more severe than their longitudinal motion (pitch motion). The hull needs a weather-vanning system involving an expensive turret and swivel system internally or externally in a severe environment condition. In addition, the natural period of vertical motion as well as transverse motion is close to a typical wave spectral peak period in most operational fields. Consequently, application of the ship-shaped FPSOs are suggested for mild environments.

To remove the need for the weather-vanning dependency in the ship-shaped vessel, a known non-ship shaped design for FPSOs is cylindrical. Examples include the cylindrical designs shown in the following patents: U.S. Pat. No. 6,945,736, U.S. Pat. No. 7,086,810, and GB 2,253,813. The hull typically has large diameter, and can accommodate a large volume of oil storage with keeping hull stability at the quayside fabrication, during wet tow, and at the installation location. The location of oil storage tank is close to the mean water level that provides benefits for designing the hull structure and processing unit on the topside. Compared with the ship-shaped FPSO, the circular hull shape also reduces the span of internal pipelines necessary to processing.

To improve the hull motion response in a severe sea state, the designed hull can include skirt pontoon at a keel level, which provides a hydrodynamic added mass and damping. Examples include the skirts on cylindrical non-ship shaped designs shown in the following patents: U.S. Pat. No. 8,511,246, U.S. Pat. No. 8,544,402, and U.S. D476,998. However, the large size of a keel skirt makes difficult the hull fabrication at the quayside and subsequent loading of the topside and equipment to the hull. The quayside fabrication facility is often limited in the outreach of a quayside crane when a desired width of the keel skirt is added to the pontoon of the hull. The maximum hull width including the keel skirt at the keel needs to be reduced during the quayside integration.

Therefore, there remains a need for an improved keel skirt to accommodate the limitations of quayside facilities for fabrication of such a floating platform.

BRIEF SUMMARY OF THE INVENTION

The present disclosure provides a hull with a pontoon and at least one keel skirt assembly extending outward from the pontoon. The keel skirt assembly can be oriented in a stored position on the pontoon to provide closer access of the pontoon to a quayside compared to the access when the keel skirt assembly is deployed. The keel skirt assembly can be articulated from the stored position to a deployed position and secured in the deployed position.

The present disclosure provides in at least one embodiment a rotatable keel skirt assembly on a generally rectangular-shaped keel pontoon. A rectangular-shaped keel pontoon reduces the maximum hull width by a significant percentage compared to a circular-shaped keel pontoon while maintaining the same hull motion performance. The rotatable keel skirt assembly allows the size of the pontoon to define the width of the hull during some fabrication phases of the platform, rather than the additional width of the keel skirt assembly. Thus, the outreach of the crane and other equipment can be effectively used as if the keel skirt assembly was not present. After fabrication, the hull can be moved away from the quayside and the keel skirt assembly can be rotated into position for service. Various systems and methods are disclosed for articulating the keel skirt assembly about the hull.

The disclosure provides a floating offshore platform for hydrocarbon storage, production, and/or offloading, comprising: a hull; a pontoon coupled to the hull; and at least one keel skirt assembly having at least one keel skirt and a support structure coupled with the keel skirt, the keel shirt assembly being coupled with the peripheral surface of the pontoon and configured to be extended and lowered from a stored position above the pontoon into a deployed position adjacent to the pontoon and extended outward from the pontoon.

The disclosure also provides a method of deploying at least one stored keel skirt assembly having at least one keel skirt and a support structure of a floating offshore platform for hydrocarbon storage, production, and/or offloading, the platform having a hull and a pontoon coupled to the hull, the keel skirt assembly being coupled to a peripheral surface of the pontoon, comprising: rotating the keel skirt assembly from a stored position above the pontoon; and lowering the keel skirt assembly to a deployed position at an elevation of the pontoon.

The disclosure further provides a floating offshore platform for hydrocarbon storage, production, and/or offloading, comprising: a hull; a pontoon coupled with the hull; and at least one keel skirt assembly having at least one keel skirt and a support structure coupled with the keel skirt, the keel skirt assembly being rotatably coupled to the pontoon, the keel skirt assembly having a stored position above the pontoon and a deployed position extendable from the pontoon.

DETAILED DESCRIPTION

Figure 1:
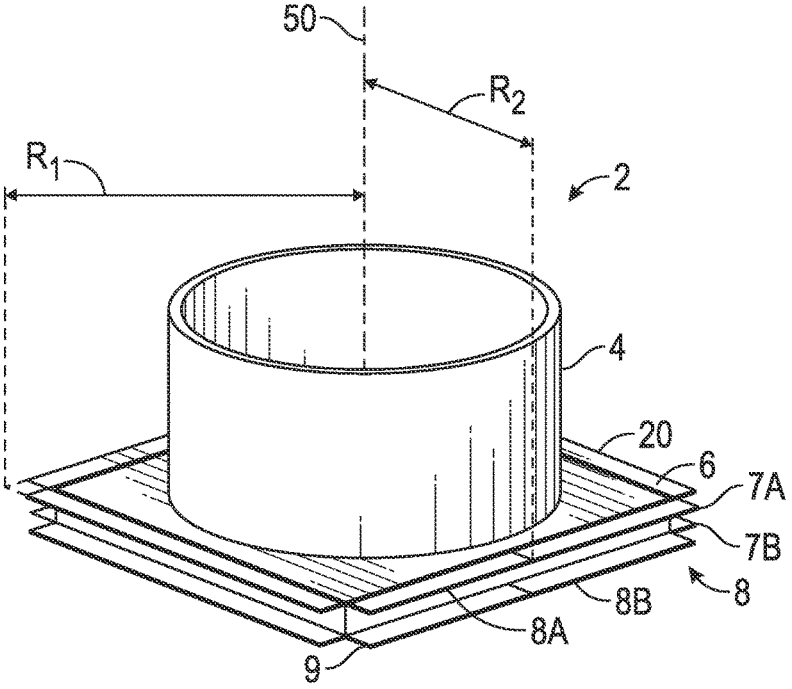
FIG. 1 is a perspective schematic view of a hydrocarbon floating offshore platform for with at least one keel skirt.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, one or more elements may have been labeled with an "A" or "B" to designate various members of a given class of an element. When referring generally to such elements, the number without the letter can be used. Further, such designations do not limit the number of members that can be used for that function.

The present disclosure provides in at least one embodiment a rotatable keel skirt assembly on a generally rectangular-shaped keel pontoon. A rectangular-shaped keel pontoon reduces the maximum hull width by a significant percentage compared to a circular-shaped keel pontoon while maintaining the same hull motion performance. The rotatable keel skirt assembly allows the size of the pontoon to define the width of the hull during some fabrication phases of the platform, rather than the additional width of the keel skirt assembly. Thus, the outreach of the crane and other equipment can be effectively used as if the keel skirt assembly was not present. After fabrication, the hull can be moved away from the quayside and the keel skirt assembly can be rotated into position for service. Various systems and methods are disclosed for articulating the keel skirt assembly about the hull.

FIG. 1 is a perspective schematic view of a hydrocarbon floating offshore platform for with at least one keel skirt assembly. The platform 2 includes a hull 4 that is coupled to a pontoon 6. In the exemplary embodiment, the hull has a circular cross-section, although it is understood that other cross-sections can be used. For the sake of illustration, a topsides is not shown, but is normally mounted on top of the hull 4 and provides the working surface for equipment and personnel for the platform. The pontoon 6 is advantageously shaped as a rectangular cross-section, although other shapes can be used. The term "rectangular" is used broadly herein and generally includes a four-sided shape with a length and a width and includes a square having an equal length and width. The exemplary embodiments illustrates a rectangular shaped pontoon having approximately an equal length and width. The rectangular cross-section allows additional volume in the corners of the rectangular base where a radial dimension $R_1$ from a centerline 50 of the hull 4 to the corner would be maximum. However, the same cross sectional area of width and length of the pontoon 6 allows a minimum radial dimension $R_2$ to occur between the centerline 50 and a perpendicular line drawn from the edge of the pontoon 6 to the centerline 50. Thus, a minimum distance from the centerline of the hull to the quayside is maintained, while still allowing a sufficiently sized pontoon volume for the structure. It is understood that different shapes can be used with varying degrees of minimal radial dimensions from the centerline 50 to the edge of the pontoon.

Further, the platform 2 can include one or more keel skirt assemblies 8. Further, each side 9 of the platform 2 can includes one or more keel skirt assemblies 8, such as a keel skirt assembly 8A and a keel skirt assembly 8B. In an exemplary embodiment, the keel skirt assembly 8 can include one or more keel skirts 7, such as a keel skirt 7A and a keel skirt 7B, at different elevations extending outwardly from a peripheral surface 20 of the pontoon 6 at the pontoon level. Alternatively, the keel skirt assembly 8 can include a single keel skirt 7 extending outwardly from the pontoon. Thus, the keel skirt assembly 8 is understood to include one or more keel skirts 7 and a support structure 12, described below in reference to FIG. 11 and others. In general, the one or more keel skirts 7 will be disposed at some elevation along the peripheral surface of the pontoon. The keel skirt assembly will be referenced herein generally as a keel skirt assembly 8, regardless of the specific quantity of keel skirts used vertically and/or peripherally around the pontoon 6.

Figure 2:
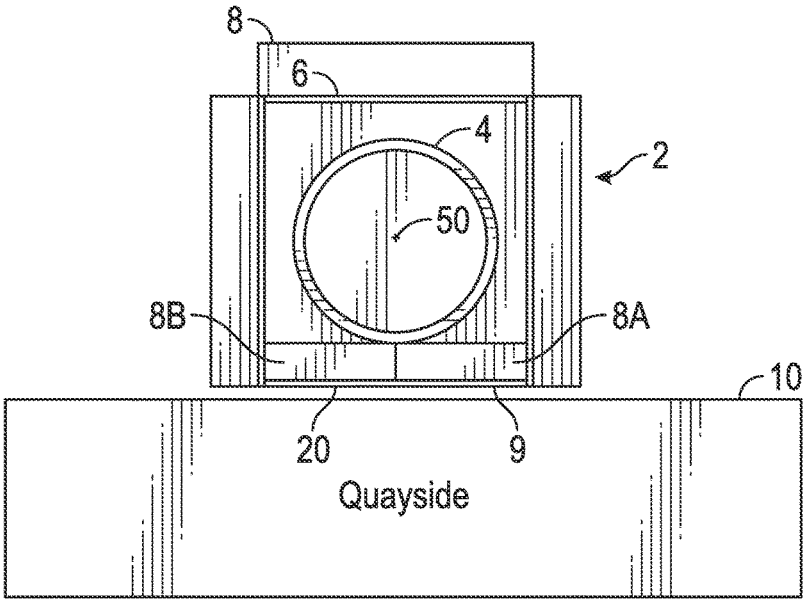
FIG. 2 is a top schematic view of the offshore platform with a keel skirt assembly in a stored position adjacent a quayside.

FIG. 2 is a top schematic view of the offshore platform with a keel skirt assembly in a stored position adjacent a quayside. The hull 4 is positioned on the pontoon 6 with one or more keel skirt assemblies 8 surrounding the pontoon 6. In this example, the keel skirt assemblies 8 are illustrated as generally deployed on three sides of the pontoon with two keel skirt assemblies 8A and 8B disposed in a storage position on the side 9 of the pontoon adjacent the quayside 10. Thus, a peripheral surface 20 of the pontoon 6 can approach the quayside 10 at a closer distance than if the at least one keel skirt assembly 8 was deployed into the position of the other keel skirt assemblies of other sides of the pontoon 6. Further, the keel skirt assemblies can be deployed at different times.

Figure 3:
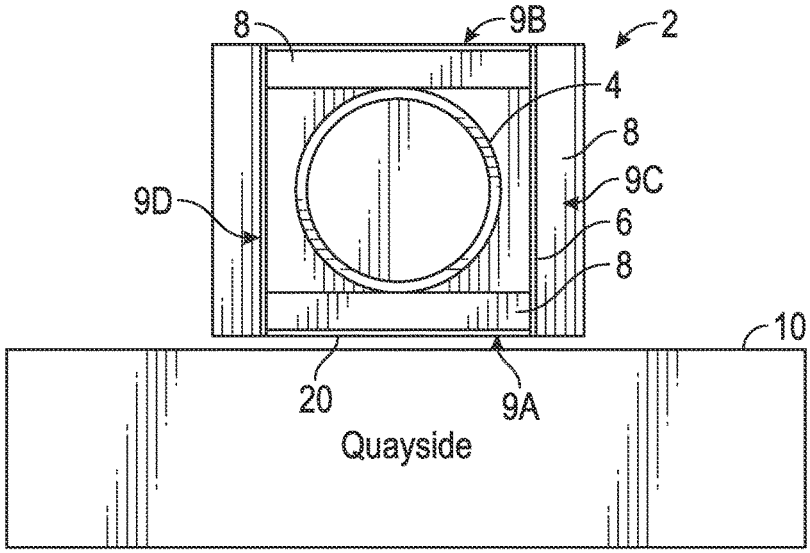
FIG. 3 is a top schematic view of the offshore platform with at least one keel skirt assembly in a storage position adjacent a quayside and at least one keel skirt assembly on another side of the pontoon in a storage position to allow multiple positions of the platform with the quayside.

FIG. 3 is a top schematic view of the offshore platform with at least one keel skirt assembly in a storage position adjacent a quayside and at least one keel skirt assembly on another side of the pontoon in a storage position to allow multiple positions of the platform with the quayside. FIG. 3 is similar to FIG. 2, but shows a plurality of keel skirt assemblies in a storage position on the pontoon 6, with one or more keel skirt assemblies being on side 9A and one or more keel skirt assemblies being on side 9B. The embodiment could be useful, for example, if some equipment were mounted on one portion of the platform with the side 9A adjacent the quayside 10, and then the platform turned around so that the side 9B was adjacent the quayside 10 to mount other equipment. In each case, the keel skirt assemblies in a storage position can be deployed after the platform is moved away from the quayside. Other keel skirt assemblies are shown in a deployed position to the left and right of the hull on sides 9C and 9D, because their positions do not affect the distance between the centerline 50 of the platform to the quayside 10.

FIGS. 4-8 illustrate a sequence of procedures in moving one embodiment of a keel skirt assembly 8 coupled to the pontoon 6 from a storage position to a deployed position. The deployed position can be the same or similar to a deployed position of another keel skirt assembly that is not movable on the pontoon.

Figure 4:
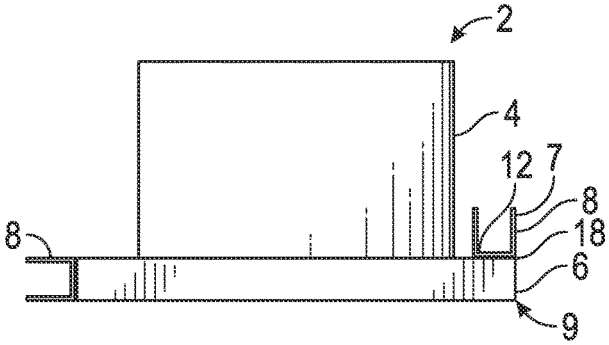
FIG. 4 is a side schematic view of the offshore platform with an exemplary embodiment of at least one keel skirt assembly in a storage position on a pontoon.

FIG. 4 is a side schematic view of the offshore platform with an embodiment of the one keel skirt assembly in a storage position on a pontoon. The platform 2 with the hull 4 can be fabricated and the keel skirt assemblies attached to the pontoon 6. As described above in FIGS. 2 and 3, at least one of the keel skirt assemblies 8 can be positioned in a storage position on a side 9, such as close to the quayside, while other keel skirt assemblies could be deployed on other sides of the pontoon. The storage position can be useful while conducting operations and assembly on the platform 2 from the quayside 10 shown above. An exemplary storage position shown in FIG. 4 is such that the keel skirts 7 of the keel skirt assembly 8 are oriented upwardly above the pontoon while a face of the support structure 12 of the keel skirt assembly 8 is adjacent or otherwise in proximity to the top surface of the pontoon 6. The structure 12 can be rotatably coupled, such as through a hinge or other rotational element, to the edge of the pontoon 6.

Figure 5:
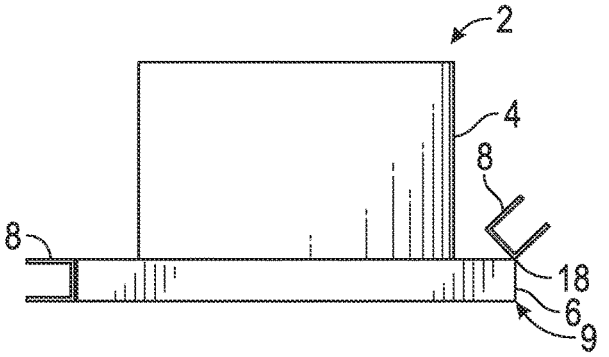
FIG. 5 is a side schematic view of the offshore platform with the keel skirt assembly being deployed by rotating outward from the pontoon.

FIG. 5 is a side schematic view of the offshore platform with the keel skirt assembly being deployed by rotating outward from the pontoon. For deployment, the keel skirt assembly 8 can be articulated about the pontoon 6. In at least one embodiment, the keel skirt assembly 8 can be rotated with a rotatable coupler 18 disposed at the top outside corner of the pontoon 6.

Figure 6:
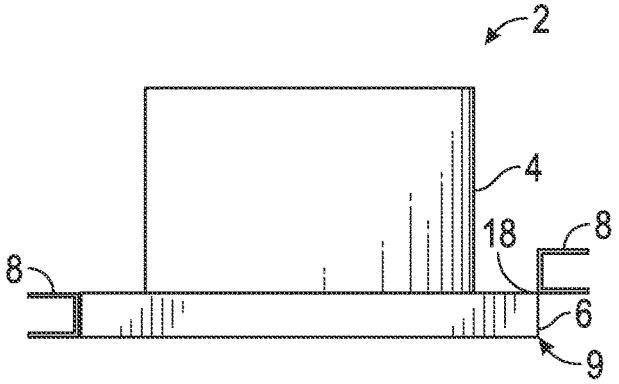
FIG. 6 is a side schematic view of the offshore platform with the keel skirt assembly being deployed to an extended position above the pontoon.

FIG. 6 is a side schematic view of the offshore platform with the keel skirt assembly being deployed to an extended position above the pontoon. The keel skirt assembly 8 has been articulated by rotation, so that the keel skirts 7 face outwardly in a final orientation, but at a higher elevation than desired for this embodiment.

Figure 7:
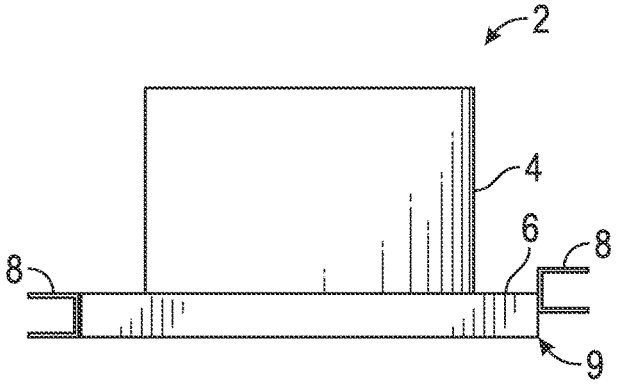
FIG. 7 is a side schematic view of the offshore platform with the keel skirt assembly being deployed by lowering along the side of the pontoon.

FIG. 7 is a side schematic view of the offshore platform with the keel skirt assembly being deployed by lowering along the side of the pontoon. The keel skirt assembly 8 can be lowered along the outward peripheral surface of the pontoon 6. The position shown in FIG. 7 is representative of an intermediate vertical position along the peripheral surface of the pontoon.

Figure 8:
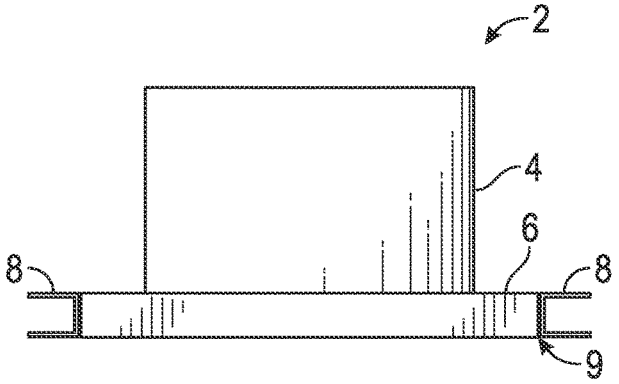
FIG. 8 is a side schematic view of the offshore platform with at least one keel skirt assembly in a deployed position on the pontoon.

FIG. 8 is a side schematic view of the offshore platform with at least one keel skirt assembly in a deployed position on the pontoon. The keel skirt assembly 8 is shown in a deployed position with the pontoon 6 similarly positioned as the keel skirt assembly 8 shown on the other side of the pontoon 6.

Figure 9:
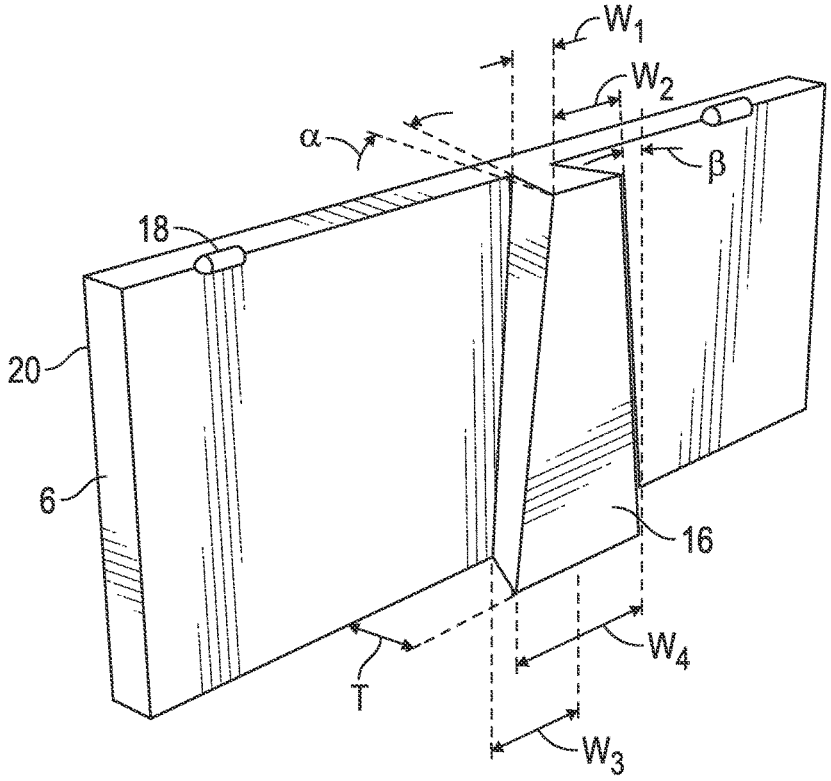
FIG. 9 is a perspective schematic detail view of at least one embodiment of the pontoon for coupling with the keel skirt assembly.

FIG. 9 is a perspective schematic detail view of at least one embodiment of the pontoon for coupling with the keel skirt assembly. In the illustrated portion of the pontoon, a guide 16, such as a key is formed or otherwise coupled with the pontoon. The guide 16 assists in guiding the keel skirt down the pontoon peripheral surface. The guide 16 can also be used to lock or otherwise secure the keel skirt in a deployed position. Further, a rotatable coupler 18, such as a hinge, is shown coupled to the pontoon at a suitable location, such as an edge of the pontoon 6 on the outward peripheral surface 20. The rotatable coupler 18 forms a pivot by which the keel skirt assembly can rotate from a stored position to a deployed position. The rotatable coupler 18 can be coupled to the keel skirt assembly in a variety of ways, such as those described herein, although other means of coupling the keel skirt assembly with the pontoon 6 can be used.

The guide 16 can have a variety of shapes with the general function of guiding the keel skirt assembly 8 as the keel skirt assembly 8 moves into a final vertical position. For the embodiment shown in FIG. 9, the guide 16 can be a key that has the various angles and tapers to facilitate the keel skirt assembly 8 being guided into final position and secured in the final position. For example and without limitation, the guide 16 can include a horizontal cross-sectional shape on a first end that has an inward width $W_1$, adjacent the peripheral surface 20 of the pontoon, that is smaller than an outward width $W_2$ Thus, the difference between the widths $W_2$ and $W_1$ form the angle "α" measured to a datum that is perpendicular to the peripheral surface 20 of the pontoon 6. Such a shape can be trapezoidal and is sometimes referred to as a "dovetail" shape. Likewise, the vertical dimension of the guide 16 can vary, such that at a second end of the guide 16, the guide 16 can have a width $W_4$ that is larger than the first end of the guide 16 with the width $W_2$. The width $W_3$ on the second end would likewise be larger than the width $W_1$ on the first end. The difference in widths $W_2$ and $W_4$ can form an angle β, using a datum as an upward vertical line that is perpendicular to the bottom or top of the pontoon or other datum that is common to the surfaces. The thickness T of the guide 16 is shown as being constant, although the thickness T could vary in a taper as well. The relative widths described above are illustrative and can vary. For example, the widths could vary such that the guide receiver travels only partially along the guide before the widths are equal and travel stops.

Figure 10A:
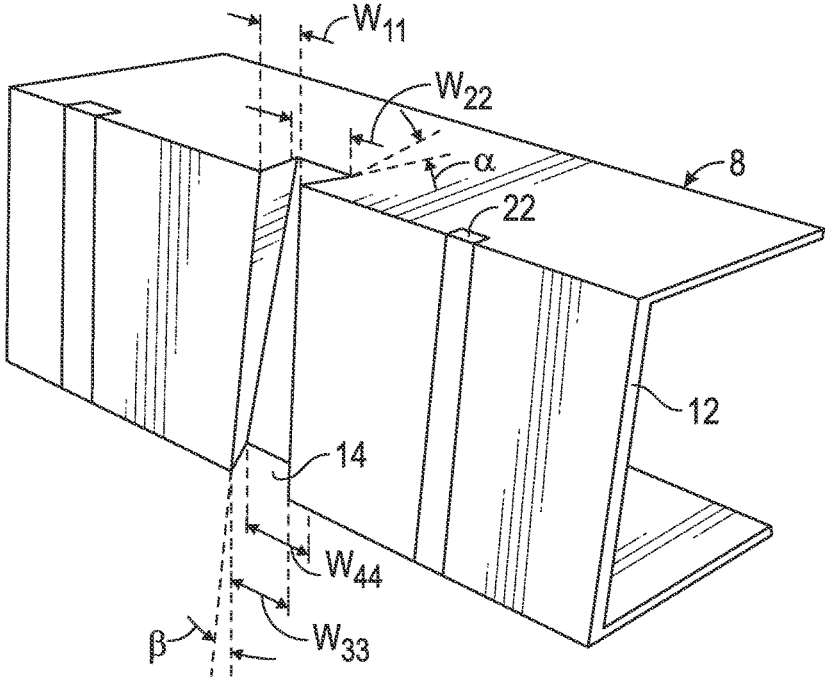
FIG. 10A is a perspective schematic detail view of at least one embodiment of the keel skirt assembly for coupling with the pontoon.
Figure 10B:
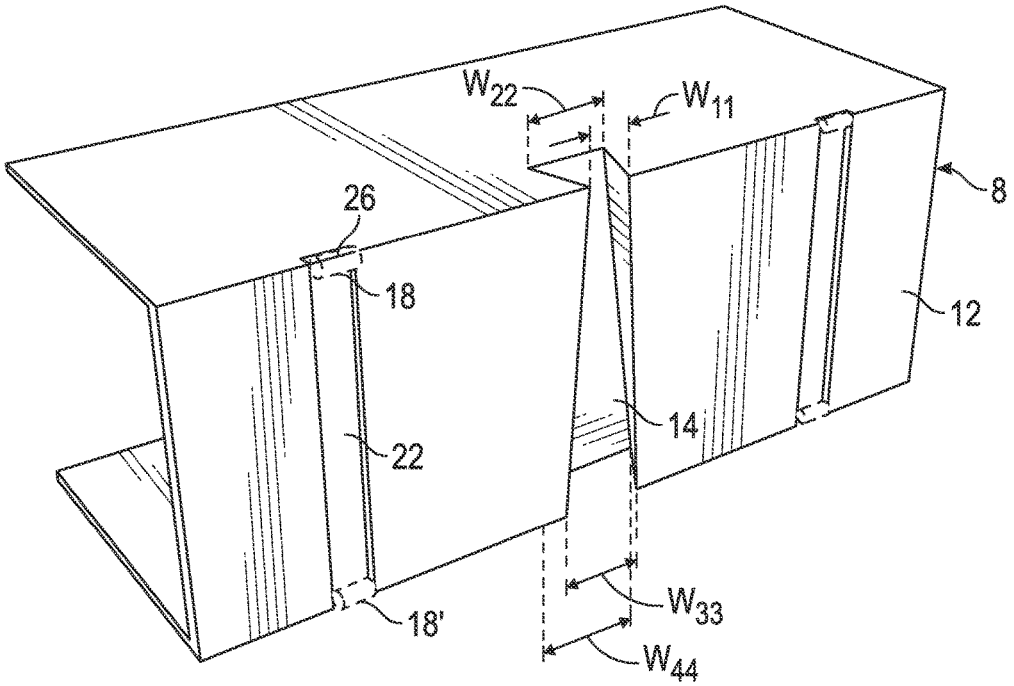
FIG. 10B is a perspective schematic detail view of the embodiment of the keel skirt assembly shown in FIG. 10A.
Figure 10C:
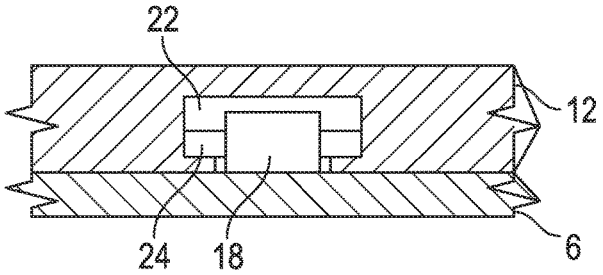
FIG. 10C is a top cross-sectional schematic detail view of a slot in the keel skirt assembly for receiving a hinge coupled with the pontoon.

FIG. 10A is a perspective schematic detail view of at least one embodiment of the keel skirt assembly for coupling with the pontoon. FIG. 10B is a perspective schematic detail view of the embodiment of the keel skirt assembly shown in FIG. 10A. FIG. 10C is a top cross-sectional schematic detail view of a slot in the keel skirt assembly for receiving a hinge coupled with the pontoon. The figures will be described in conjunction with each other. The keel skirt assembly 8 is shown with for example a keel skirt 7A and a keel skirt 7B at a different elevation than the keel skirt 7A. A corresponding guide receiver 14, such as keyway, formed in the support structure 12 of the keel skirt assembly 8 is configured to receive the guide 16. The shape of the guide receiver 14 can correspond to the shape of the guide 16. Thus, for the shape shown in FIG. 9 of the guide 16, the width $W_{11}$ at a first end of the guide receiver 14 can correspond to the width $W_1$, subject to whatever clearances are appropriate for the particular size and desired ease of installation. Similarly, the width $W_{22}$ at the wider portion on the first end of the guide receiver 14 can correspond to the width $W_2$ on the guide 16. On the second end of the guide receiver 14, the width $W_{33}$ can correspond with the width $W_3$ of the guide 16 in FIG. 9. The width $W_{44}$ on the second end of the guide receiver 14 can correspond to the width $W_4$ of the guide 16. The angles α and β formed in the guide receiver 14 will be consistent within a given tolerance with the angles α and β of the guide 16 described in FIG. 9. The shape of the guide and guide receiver is intended to allow the keel skirt assembly 8 to be positioned above the guide and as the keel skirt assembly 8 lowers into position on the pontoon, the relative dimensions and angles of the guide and guide receiver interact, so that the keel skirt assembly 8 is locked or otherwise secured into position against the pontoon 6 in the final deployed position.

Slots 22 formed in the keel skirt assembly 8 are also shown in FIGS. 10A and 10B. The slots 22 are formed in the support structure 12 of the keel skirt assembly 8 to receive the rotatable couplers 18. The slots 22 can have a closed cross-section on one or both ends with stops 26, so that the keel skirt assembly 8 is restrained from becoming uncoupled with the pontoon 6. The stops 26 at the one or more ends of the slot 22 can be a plate or other restraining element. The rotatable coupler 18, when engaged within the slot 22 of the keel skirt assembly 8, allows the keel skirt assembly 8 to rotate about the pontoon 6 as well as be lowered into position along the peripheral surface of the pontoon 6, as illustrated in the two positions of the rotatable coupler 18 in FIG. 10B.

The rotatable coupler 18 can be restrained within the slot 22. For example and without limitation, the slot 22 can be formed as a "T" slot, as shown in FIG. 100. The rotatable coupler 18 can have one or more extensions 24, such as pins, that restrain the rotatable coupler within the "T" slot, but also allow a portion of the rotatable coupler to be coupled to the pontoon 6.

Figure 11:
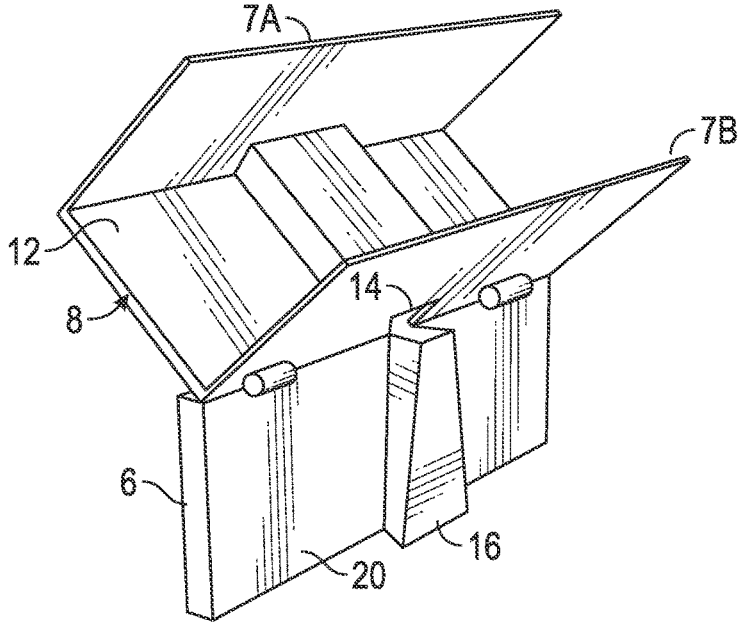
FIG. 11 is a perspective schematic view of the keel skirt assembly being articulated about a coupler on the pontoon.

FIG. 11 is a perspective schematic view of the keel skirt assembly being articulated about a rotatable coupler on the pontoon. In the exemplary embodiment, the rotatable coupler 18 can be coupled to an edge of the pontoon 6, such as adjacent to the peripheral surface 20 and be coupled as described in reference to FIGS. 10A through 100 to the slot 22 on the support structure 12 of the keel skirt assembly 8. The keel skirt assembly 8 can be rotated outwardly away from the hull using the rotatable coupler 18 and allow the guide receiver 14 to be aligned with the guide 16. Further, when multiple keel skirt assemblies are used such as along a given side of the pontoon, the keel skirt assemblies can be deployed at various times and in various manners. The figures herein generally illustrate a keel skirt assembly with two keel skirts, with the understanding that the number of keel skirts can vary.

Figure 12:
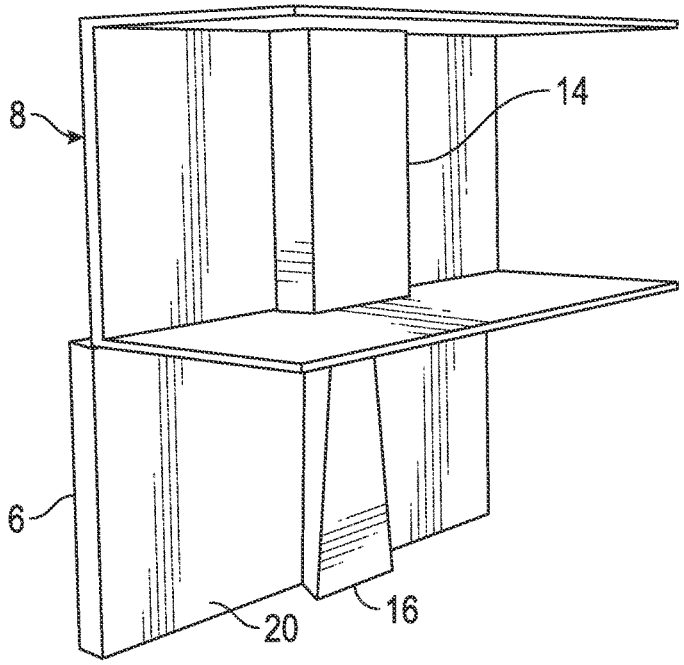
FIG. 12 is a perspective schematic view of the keel skirt assembly of FIG. 11 fully articulated above the pontoon.

FIG. 12 is a perspective schematic view of the keel skirt assembly of FIG. 11 fully articulated above the pontoon. Once the keel skirt assembly 8 is rotated so that the keel skirt(s) faces outwardly, the keel skirt assembly will generally be in a higher elevational position in this embodiment as an intermediate step than the final deployed position adjacent the peripheral surface of the pontoon 6. The guide receiver 14 is shown aligned and may engage the guide 16.

Figure 13:
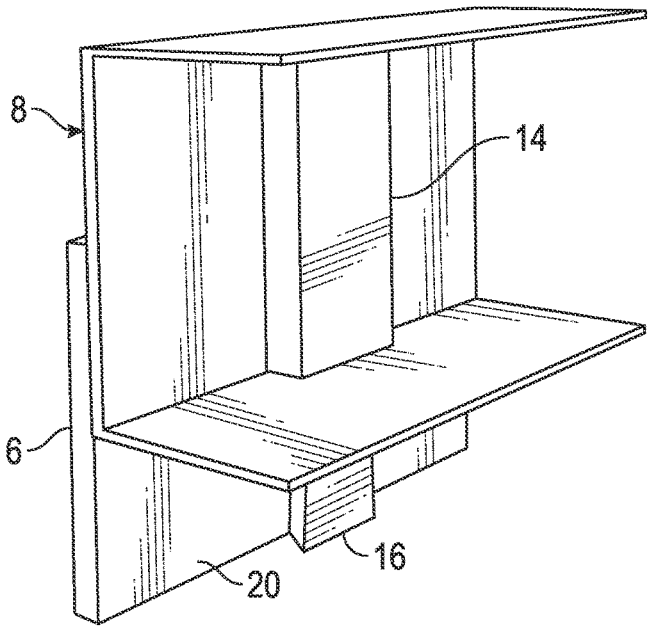
FIG. 13 is a perspective schematic view of the keel skirt assembly being lowered on the pontoon.

FIG. 13 is a perspective schematic view of the keel skirt assembly being lowered on the pontoon. The keel skirt assembly 8 can be lowered along the peripheral surface 20 of the pontoon 6, so that the guide receiver 14 progressively engages more of the guide 16.

Figure 14:
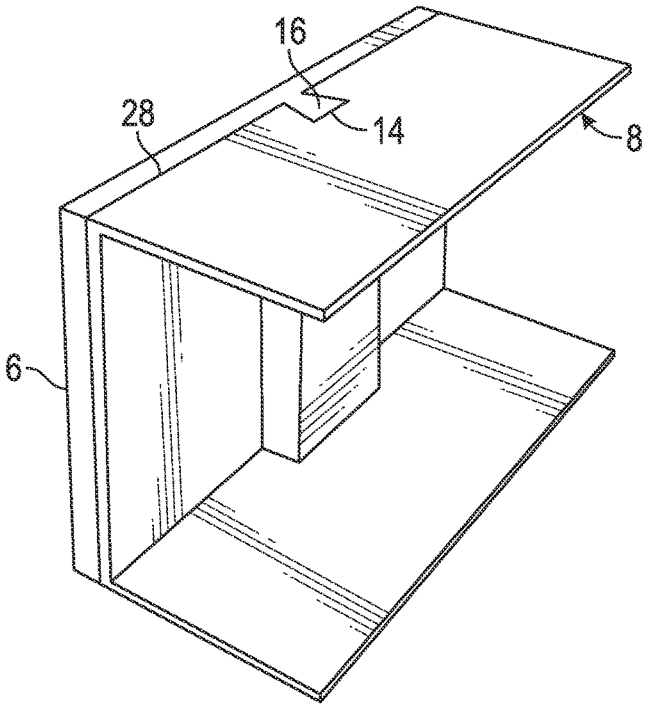
FIG. 14 is a perspective schematic view of the keel skirt assembly fully lowered on the pontoon.

FIG. 14 is a perspective schematic view of the keel skirt assembly fully lowered on the pontoon. Once the guide receiver 14 has fully engaged the guide 16 and travel stopped along the guide, the keel skirt assembly 8 is fully deployed with the pontoon 6. An interface 28 between the pontoon 6 and keel skirt assembly 8 can be further secured if desired with plates, pins, bolts, welds, or other fastening means.

FIGS. 15 through 18 illustrate at least one exemplary system for moving the keel skirt assembly 8 from a stored position above the pontoon into a deployed position with the pontoon.

Figure 15:
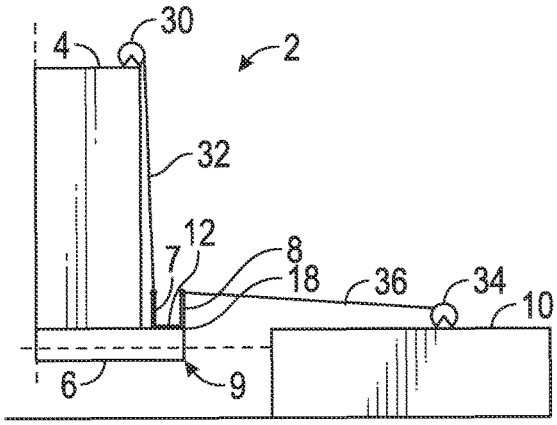
FIG. 15 is a side schematic view of the articulating keel skirt assembly shown in a storage position.

FIG. 15 is a side schematic view of the articulating keel skirt assembly shown in a storage position. The keel skirt assembly 8 is shown in a stored position above the pontoon 6 with the keel skirts 7 oriented at an angle to the pontoon, such as upwardly from the pontoon, so that the support structure 12 is adjacent or otherwise in proximity to the pontoon. The keel skirt assembly 8 can be coupled to the pontoon 6 with the rotatable coupler 18. A winch 30 can be installed on the hull 4 and a winch line 32 extended to an appropriate position on the keel skirt assembly 8. The winch 30 can also be preinstalled to be used later with the hull to moor the platform to a seabed during production. Further, a winch 34 can be installed on the quayside 10 and a winch line 36 extended to an appropriate position on the keel skirt assembly 8.

Figure 16:
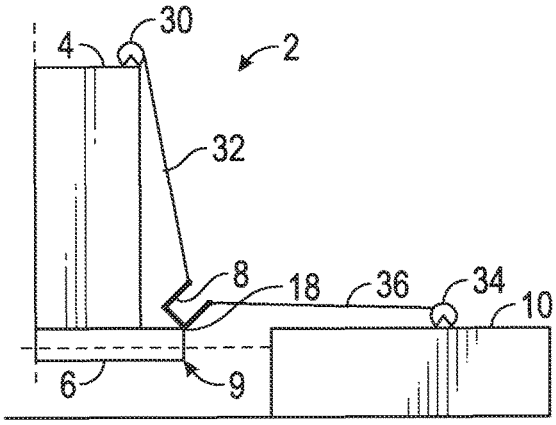
FIG. 16 is a side schematic view of the articulating keel skirt assembly shown in a partially deployed position.

FIG. 16 is a side schematic view of the articulating keel skirt assembly shown in a partially deployed position. The winch 34 on the quayside 10 can be activated to pull the winch line 36 and thereby pull the keel skirt assembly 8 to articulate the keel skirt assembly about the rotatable coupler 18. The winch line 32 from the winch 30 can be controllably released to help control the angle and speed of the keel skirt assembly articulation from the winch line 36.

Figure 17:
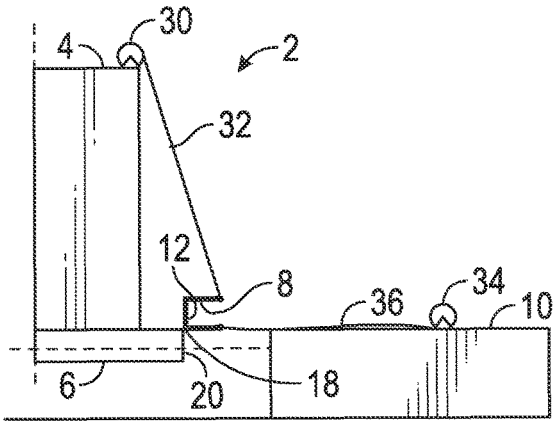
FIG. 17 is a side schematic view of the articulating keel skirt assembly shown in a partially deployed fully articulated position.

FIG. 17 is a side schematic view of the articulating keel skirt assembly shown in a partially deployed, fully articulated position. Once the keel skirt assembly 8 has been fully articulated, such as by rotation, about the rotatable coupler 18, the winch 34 can be stopped so that the winch line 36 no longer pulls the keel skirt assembly 8. The keel skirt assembly 8 can be held in position with the keel skirts 7 oriented outwardly using the winch line 32 from the winch 30. In the illustrated embodiment, the support structure 12 is in position to be lowered along the peripheral surface 20 of the pontoon 6 to a fully deployed position.

Figure 18:
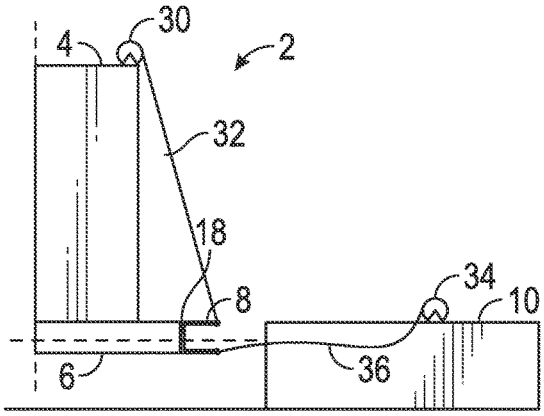
FIG. 18 is a side schematic view of the articulating keel skirt assembly shown in a fully deployed position.

FIG. 18 is a side schematic view of the articulating keel skirt assembly shown in a fully deployed position. The winch 30 can let out the winch line 32 in a controlled manner to control the lowering of the keel skirt assembly 8 along the peripheral surface of the pontoon 6 for deployment while the winch line 36 is slack. As described above, the guide receiver on the keel skirt assembly can engage and secure the guide on the pontoon in the deployed position.

FIGS. 19 through 26 illustrate a second embodiment of the keel skirt assembly 8 being coupled with the pontoon 6 and being moved from a storage position into a deployed position. Thus, rotating the keel skirt assembly from a stored position above the pontoon and lowering the keel skirt assembly to a deployed position at an elevation of the pontoon occurs through the process of rotating the keel skirt assembly through the range of motion. Similar elements are similarly numbered as described in the first embodiment and the functionalities in general were similar.

Figure 19:
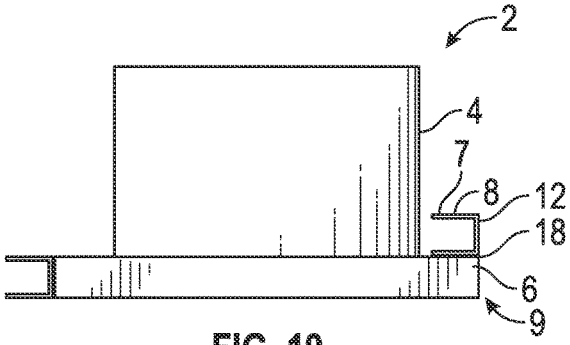
FIG. 19 is a side schematic view of another embodiment of the keel skirt assembly coupled to the hull and disposed in a storage position.

FIG. 19 is a side schematic view of another embodiment of the keel skirt assembly coupled to the hull and disposed in a storage position. In this embodiment, the platform 2 with the hull 4 has the keel skirt assembly 8 rotatably coupled with the pontoon 6 along at least one side 9. However, the keel skirt assembly 8 is stored in a position above the pontoon 6 with the keel skirts 7 oriented toward the hull 4 rather than being oriented upward as in the first embodiment. Thus, the storage position is such that a keel skirt 7 is adjacent or in proximity to the top surface of the pontoon 6 and the support structure 12 of the keel skirt assembly is oriented generally vertically in an outward facing direction from the platform. The keel skirt assembly 8 is coupled to the pontoon 6 with the rotatable element 18.

Figure 20:
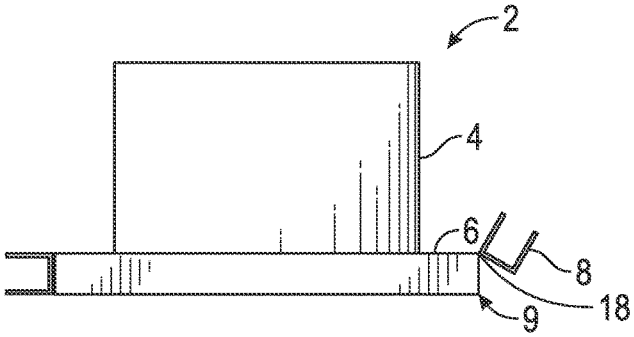
FIG. 20 is a side schematic view of the keel skirt assembly of FIG. 19 shown in a partially deployed, partially articulated position.

FIG. 20 is a side schematic view of the keel skirt assembly of FIG. 19 shown in a partially deployed, partially articulated position. To deploy the keel skirt assembly 8, the keel skirt assembly is articulated about the rotatable coupler 18. As shown in FIG. 20, the keel skirt assembly is in an intermediate position.

Figure 21:
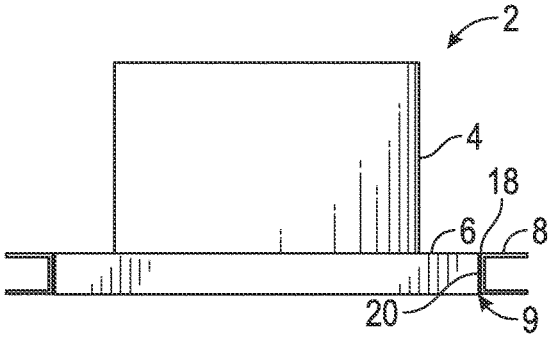
FIG. 21 is a side schematic view of the keel skirt assembly of FIG. 20 shown in a fully deployed position.

FIG. 21 is a side schematic view of the keel skirt assembly of FIG. 20 shown in a fully deployed position. The keel skirt assembly 8 is adjacent the peripheral surface 20 of the pontoon 6 in a fully deployed position.

Figure 22A:
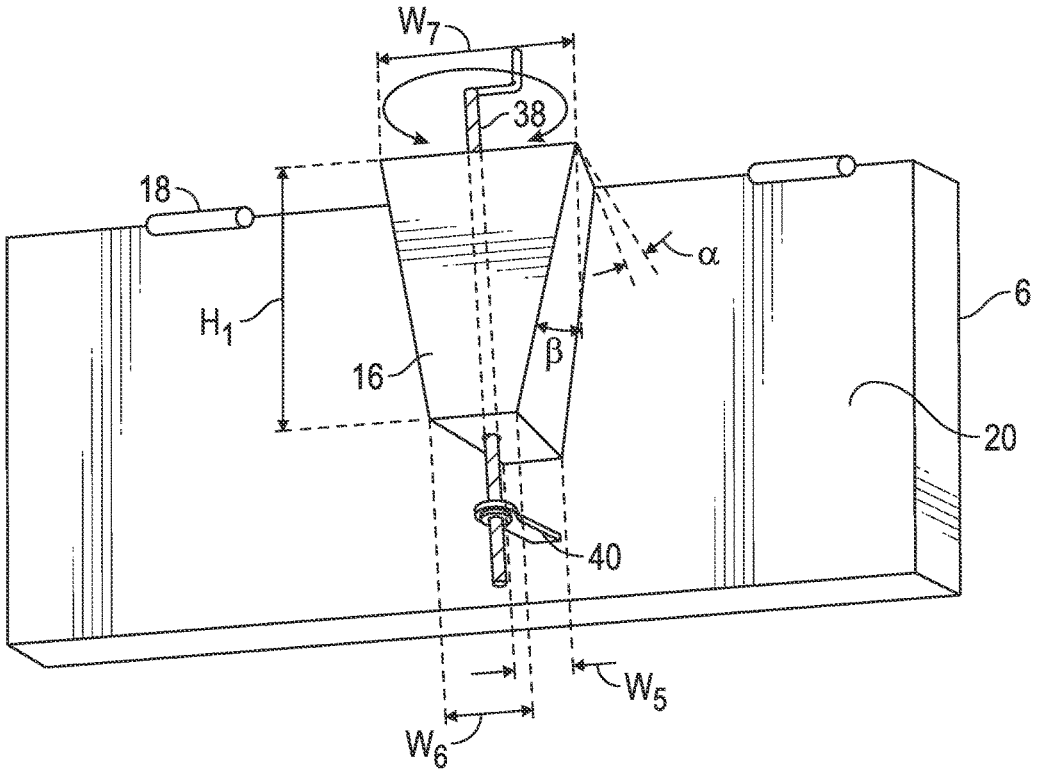
FIG. 22A is a perspective schematic view of an exemplary pontoon portion of a coupling system for the pontoon with the keel skirt assembly.
Figure 22B:
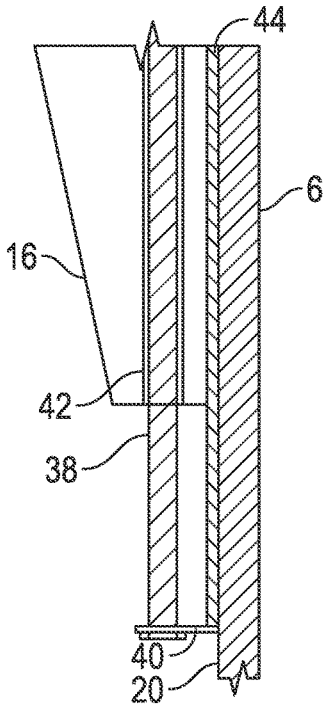
FIG. 22B is a cross-sectional schematic detail view of the exemplary pontoon portion of a coupling system with an actuator for moving the elevation of the pontoon portion of the coupling system.
Figure 22C:
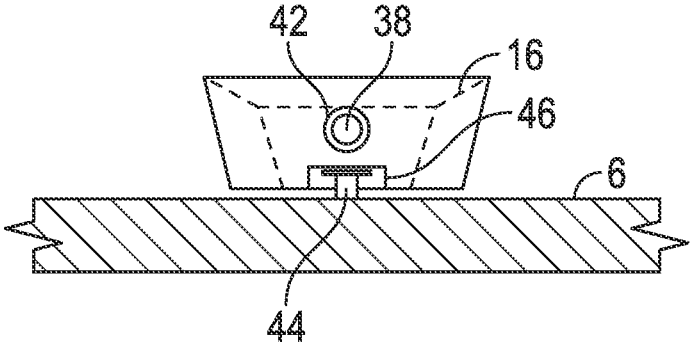
FIG. 22C is a top cross-sectional view of the pontoon portion of a coupling system shown in FIGS. 22A and 22B.

FIG. 22A is a perspective schematic view of an exemplary pontoon portion of a coupling system for the pontoon with the keel skirt assembly. FIG. 22B is a cross-sectional schematic detail view of the exemplary pontoon portion of a coupling system with an actuator for moving the elevation of the pontoon portion of the coupling system. FIG. 22C is a top cross-sectional view of the pontoon portion of the coupling system shown in FIGS. 22A and 22B. The figures will be described in conjunction with each other. A guide 16 can be coupled with the pontoon 6 along the peripheral surface 20. The guide 16 can be a similar shape with the dovetail and angles, $\alpha$ and $\beta$, that were described above in reference to FIGS. 9, 10A, and 10B, although the shape can vary and other guides and guide receivers are capable of functioning in a similar manner to couple the keel skirt assembly 8 with the pontoon 6.

In this exemplary embodiment, the guide 16 can move vertically along the peripheral surface 20 of the pontoon 6 through the use of an actuator 38. The actuator 38 can be coupled through a support 40 to the pontoon 6. For example and without limitation, the actuator 38 can be a manual actuator, such as a screw mechanism, with a follower 42 in the guide 16 threadably engaged with the actuator 38. As the actuator 38 is rotated, the follower 42 rises and lowers according to the rotation of the actuator screw with the follower. The guide 16 rises and lowers as the follower 42 rises and lowers. The guide can be laterally secured to the pontoon 6 and still allow vertical movement. For example, a guide support 44, such as a rail, can be coupled with the pontoon, and can slidably engage a corresponding slot 46, such as "T" slot, longitudinally formed or otherwise coupled with the guide 16.

The guide 16 having a height $H_1$ can include a width $W_7$ on one end of the guide 16, such as at a top surface. Further, the guide 16 can include a width $W_6$ at another end of the guide 16 such as a lower surface, so that the width $W_6$ is less than the width $W_7$. In a similar manner as described above for the first embodiment, the guide 16 can include a width $W_5$ that is smaller than the width $W_6$ and thus forms the angle $\alpha$.

Figure 23:
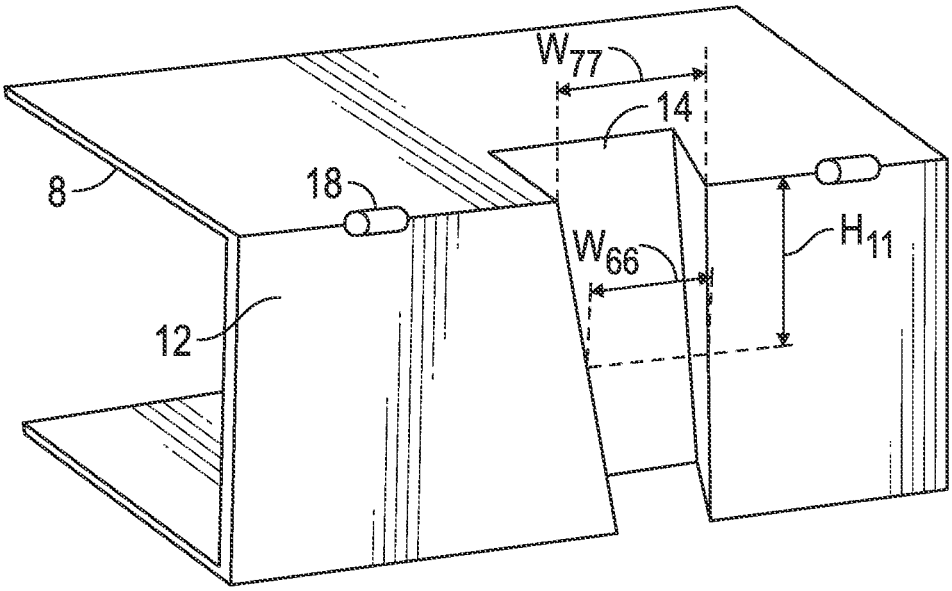
FIG. 23 is a perspective schematic view of an exemplary keel skirt assembly portion of the coupling system for coupling the pontoon to the keel skirt assembly.

FIG. 23 is a perspective schematic view of an exemplary keel skirt assembly portion of the coupling system for coupling the pontoon with the keel skirt assembly. A guide receiver 14 can be formed in the keel skirt assembly 8, such as in the support structure 12. The guide receiver can correspond to fit with the size and shape of the guide in FIG. 22A. The rotatable coupler 18 is shown coupled to the keel skirt assembly 8 in FIG. 23 as well as the pontoon 6 in FIG. 22A to illustrate that the coupler 18 can be used to couple the pontoon with the keel skirt assembly. Generally, the widths $W_7$, and $W_{66}$ spaced by a height $H_{11}$, corresponding to the guide height $H_1$, are sized and shaped to provide clearance (that is, larger) for the guide 16 having the widths $W_7$ and $W_6$ spaced by the height $H_1$, so that as the keel skirt assembly 8 is rotated into position on the pontoon 6 in this embodiment, the guide receiver can engage the guide 16. The guide 16 can then be lowered further into the guide receiver 14 to secure the keel skirt assembly 8 with the pontoon 6 without requiring further vertical movement of the keel skirt assembly 8 along the peripheral surface 20 of the pontoon 6. Thus, when lowered into position, the guide 16 secures the lateral and outward movement of the keel skirt assembly 8 from the pontoon 6. In this embodiment, the shape of the guide 16 and guide receiver 14 do not restrict further downward movement of the keel skirt assembly 8, but rather the keel skirt assembly 8 is held in vertical position with the rotatable coupler 18. Therefore, after the keel skirt assembly 8 is rotated into position along the peripheral surface of the pontoon, the keel skirt assembly can optionally be further secured to the pontoon by bracing plates, welding, bolts, or other fastening means.

Figure 24:
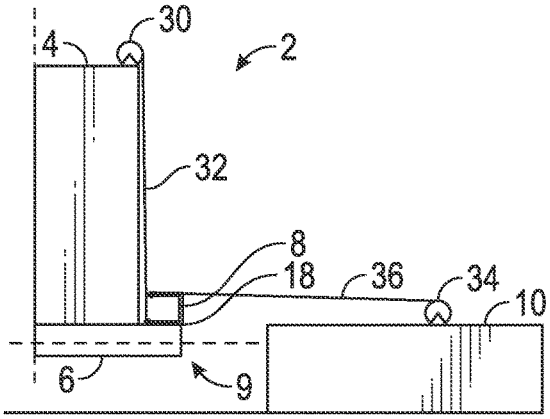
FIG. 24 is a side schematic view of the articulating keel skirt assembly of FIG. 23, shown in a storage position.
Figure 25:
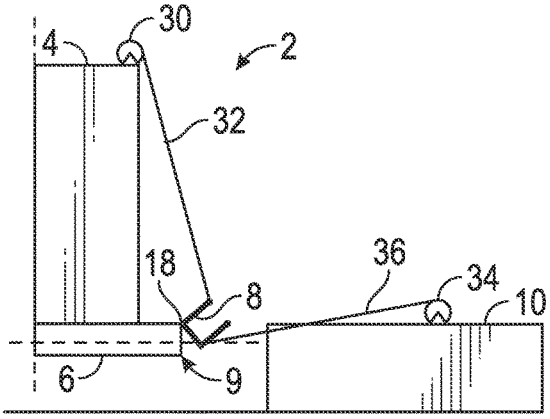
FIG. 25 is a side schematic view of the articulating keel skirt assembly shown in a partially deployed position.
Figure 26:
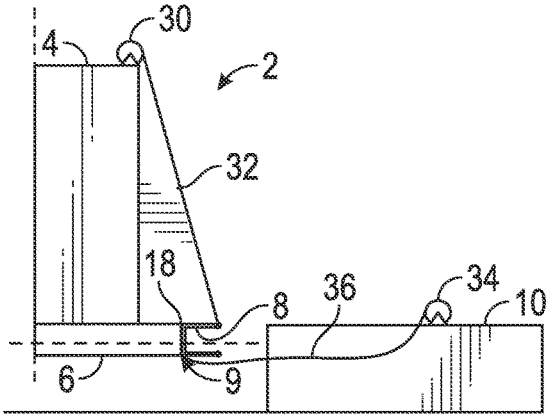
FIG. 26 is a side schematic view of the articulating keel skirt assembly shown in a fully deployed position.

FIGS. 24-26 illustrate an exemplary method of moving the keel skirt assembly 8 from a stored position to a fully deployed position.

FIG. 24 is a side schematic view of the articulating keel skirt assembly of FIG. 23, shown in a storage position. A winch 30 that is mounted to the hull 4 can deploy a winch line 32 and be coupled to an appropriate portion of the keel skirt assembly 8, such as a low portion of the keel skirt assembly 8 as shown. A winch 34 can be coupled to the quayside 10 and deploy a winch line 36 to an appropriate portion of the keel skirt assembly 8. The two winches 30 and 34 can together control the rotation of the keel skirt assembly about the rotatable coupler 18.

FIG. 25 is a side schematic view of the articulating keel skirt assembly shown in a partially deployed position. The winch 34 on the quayside 10 can pull the winch line 36, so that the keel skirt assembly 8 is rotated outwardly away from the hull 4. The winch 30 with the winch line 32 can control the outward movement of the keel skirt assembly 8 by controlling the deployment of the winch line 32.

FIG. 26 is a side schematic view of the articulating keel skirt assembly shown in a fully deployed position. Once the center of gravity of the keel skirt assembly 8 is past the edge of the pontoon 6, the winch line 36 no longer needs to pull on the keel skirt assembly 8. Rather, the winch line 32 from the winch 30 controls the descent of the keel skirt assembly as it rotates about the rotatable coupler 18. The winch 32 allows the keel skirt assembly 8 to be fully rotated into position against the peripheral surface of the pontoon 6 where the keel skirt assembly 8 can be further secured from further movement with the pontoon 6.

While the embodiments disclosed herein illustrate a guide 16 coupled to the pontoon peripheral surface 20 and the guide receiver 14 coupled to the support structure 12 of the keel skirt assembly 8, it is to be understood that other embodiments are contemplated. For example and without limitation, the respective positions of the guides and guide receivers can be reversed so that the guide receiver 14 is formed or otherwise coupled with the pontoon 6, and the guide 16 is coupled with the keel skirt assembly 8. Further, the guide 16 and guide receiver 14 can be reversed in orientation vertically, such as the larger portion of the guide and guide receiver can be on the top or bottom and mechanisms be used to adjust the guide or the guide receiver location to secure the keel skirt assembly 8 with the pontoon 6. For example, the guide 16 shown in FIG. 22A could be located on a lower portion of the pontoon and pulled upward into position rather than pushed downward into position with the corresponding change in the guide receiver 14 of FIG. 23. As another illustrative variation, the actuator 38 can be a hydraulic or pneumatic cylinder and pump system, linear actuator, or other type of actuator. Lastly, while the illustrative embodiments show the keel skirt assembly on an elevation with the pontoon, the elevation can vary either above or below the pontoon, for example by the use of frame members or other structure.

Other and further embodiments utilizing one or more aspects of the invention described above can be devised without departing from the spirit of Applicant's invention. For example, different sized and shaped guides and guide receivers can be used, different types of rotatable couplers, one or two or more keel skirt assemblies for a given side of a pontoon, different means of securing the components in their respective positions, and other variations can be made and are in keeping within the scope of the claims.

Further, the various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A floating offshore platform for hydrocarbon storage, production, and/or offloading, comprising:

a hull;

a pontoon coupled to the hull; and a keel skirt assembly having a keel skirt and a support structure coupled with the keel skirt, the keel skirt assembly being coupled with a peripheral surface of the pontoon and disposed between a stored position above the pontoon with at least a portion of the keel skirt assembly disposed inwardly from the peripheral surface and a deployed position adjacent to the pontoon that is lowered and extended outward from the pontoon compared to the stored position.

2. The platform of claim 1, wherein the keel skirt assembly is rotatably coupled with the peripheral surface of the pontoon and rotatable about the peripheral surface so that the keel skirt extends outwardly from the pontoon.

3. The platform of claim 2, further comprising a guide on one of the pontoon and the keel skirt assembly and a guide receiver on the other of the pontoon and the keel skirt assembly.

4. The platform of claim 3, wherein the keel skirt assembly is disposed along the peripheral surface of the pontoon with the guide and the guide receiver.

5. The platform of claim 3, wherein the keel skirt assembly is secured with the guide and guide receiver to the pontoon in the deployed position.

6. The platform of claim 1, wherein the keel skirt assembly comprises a first keel skirt at a first elevation and a second keel skirt at a second elevation different than the first elevation.

7. The platform of claim 1, wherein the stored position reduces a distance from a centerline of the platform to an edge of the platform compared to the deployed position.

8. The platform of claim 1, wherein a distance from a centerline of the platform to a quayside is minimal when the keel skirt assembly is in the stored position compared to when the keel skirt assembly is in the deployed position.

9. A method of deploying a stored keel skirt assembly having a keel skirt and a support structure of a floating offshore platform for hydrocarbon storage, production, and/or offloading, the platform having a hull and a pontoon coupled to the hull, the keel skirt assembly being coupled to a peripheral surface of the pontoon, comprising:

rotating the keel skirt assembly from a stored position above the pontoon with at least a portion of the keel skirt assembly disposed inwardly from the peripheral surface; and lowering the keel skirt assembly to a deployed position at an elevation of the pontoon.

10. The method of claim 9, wherein rotating the keel skirt assembly comprises rotating about a peripheral surface of the pontoon so that the keel skirt assembly extends outwardly from the pontoon.

11. The method of claim 9, wherein lowering the keel skirt assembly to the deployed position at the elevation of the pontoon comprises slidably lowering the keel skirt assembly along the peripheral surface of the pontoon.

12. The method of claim 11, wherein slidably lowering the keel skirt assembly comprises guiding the keel skirt assembly down the pontoon using a guide and guide receiver coupled to the pontoon and the keel skirt assembly.

13. The method of claim 9, wherein lowering the keel skirt assembly to the deployed position comprises rotating the keel skirt assembly to the elevation of the pontoon.

14. The method of claim 9, wherein rotating the keel skirt assembly and lowering the keel skirt assembly comprises rotating about a peripheral surface of the pontoon so that the keel skirt assembly extends outwardly from the pontoon at the elevation of the pontoon.

15. The method of claim 9, further comprising securing the keel skirt assembly with the pontoon in the deployed position.

16. The method of claim 9, further comprising reducing a distance from a centerline of the platform to a quayside when the keel skirt assembly is in the stored position compared to when the keel skirt is in the deployed position.

17. The method of claim 9, further comprising deploying a plurality of keel skirt assemblies from a stored position at different times.

18. A floating offshore platform for hydrocarbon storage, production, and/or offloading, comprising:

a hull;

a pontoon coupled with the hull; and a keel skirt assembly having a keel skirt and a support structure coupled with the keel skirt, the keel skirt assembly being rotatably coupled to the pontoon, the keel skirt assembly having a stored position above the pontoon with at least a portion of the keel skirt assembly disposed inwardly from the peripheral surface and a deployed position extendable from the pontoon.

* * * * *